US012326000B2

(12) United States Patent
Fee et al.

(10) Patent No.: US 12,326,000 B2
(45) Date of Patent: Jun. 10, 2025

(54) HANDRAIL ATTACHMENT SYSTEM AND METHOD

(71) Applicant: Artistic Southern, Inc., Alpharetta, GA (US)

(72) Inventors: Kyle Fee, Alpharetta, GA (US); Judd Mincey, Alpharetta, GA (US); Randy Scott, Alpharetta, GA (US)

(73) Assignee: Artistic Southern, Inc., Alpharetta, GA (US)

( * ) Notice: Subject to any disclaimer, the term of this patent is extended or adjusted under 35 U.S.C. 154(b) by 0 days.

(21) Appl. No.: 18/764,708

(22) Filed: Jul. 5, 2024

(65) Prior Publication Data

US 2024/0360675 A1 Oct. 31, 2024

Related U.S. Application Data

(63) Continuation of application No. 17/590,902, filed on Feb. 2, 2022, now Pat. No. 12,031,333.

(60) Provisional application No. 63/145,056, filed on Feb. 3, 2021.

(51) Int. Cl.
*E04F 11/18* (2006.01)

(52) U.S. Cl.
CPC ..... *E04F 11/1817* (2013.01)

(58) Field of Classification Search
CPC ..... E04F 11/1802; E04F 11/1804; E04F 17/1413; E04F 17/1447; E04F 17/1452; E04F 17/1488; E04F 11/18; E04F 11/1808; E04F 11/181; E04F 11/1812; E04F 11/1817; E04F 11/1836; E04F 2011/1819; E04F 2011/1821
See application file for complete search history.

(56) References Cited

U.S. PATENT DOCUMENTS 4,193,586 A * 3/1980 Guenther ..... E04F 11/1804 256/69
5,419,538 A * 5/1995 Nicholas ..... E04F 11/1812 403/258
5,788,224 A * 8/1998 Platt ..... E04H 17/1417 52/656.9
10,119,277 B1 * 11/2018 Tscherkaschin ..... A47K 17/022
2006/0175594 A1 * 8/2006 Burkart ..... E04H 17/1488 256/65.02
2007/0138457 A1 * 6/2007 Johnstonbaugh ... E04F 11/1817 256/67

(Continued)

FOREIGN PATENT DOCUMENTS

CA 2448732 A1 * 5/2005 ..... E04F 11/1812
DE 3702128 A1 * 8/1988

(Continued)

*Primary Examiner* — Jonathan P Masinick
(74) *Attorney, Agent, or Firm* — Womble Bond Dickinson (US) LLP

(57) ABSTRACT

A handrail attachment system. The system can comprise a connector comprising a body for being at least partially received in a recess in a support structure and an outer face for engaging an end face of a handrail. The connector can include a handrail mounting hole for at least partially receiving a first fastener for at least partially mounting the connector to the end face of the handrail and a support mounting hole for at least partially receiving a second fastener for mounting the connector to the support structure.

19 Claims, 6 Drawing Sheets

(56) References Cited

U.S. PATENT DOCUMENTS

| | | | | |
|---|---|---|---|---|
| 2008/0080173 | A1* | 4/2008 | Trimble | E04F 11/18<br>362/146 |
| 2009/0255066 | A1* | 10/2009 | Brock | E04F 11/181<br>52/7 |
| 2020/0284040 | A1* | 9/2020 | Warshaw | E04F 11/1808 |

FOREIGN PATENT DOCUMENTS

| | | | | |
|---|---|---|---|---|
| DE | 9407153 | U1 * | 7/1994 | |
| DE | 10101782 | A1 * | 10/2001 | E04F 11/1804 |
| DE | 10053985 | A1 * | 5/2002 | E04F 11/035 |
| DE | 10358766 | A1 * | 7/2005 | E04F 11/1812 |
| DE | 202011005520 | U1 * | 10/2011 | E04F 11/1804 |
| EP | 0688920 | A1 * | 12/1995 | |
| GB | 2449666 | A * | 12/2008 | E04F 11/1836 |
| JP | 3391230 | B2 * | 3/2003 | E04F 11/1836 |
| KR | 20070000086 | U * | 1/2007 | |

* cited by examiner

HANDRAIL ATTACHMENT SYSTEM AND METHOD

CROSS-REFERENCE TO RELATED APPLICATIONS

This application is a continuation of U.S. patent application Ser. No. 17/590,902, filed on Feb. 2, 2022, which claims the benefit of U.S. Provisional Patent Application No. 63/145,056 filed on Feb. 3, 2021.

INCORPORATION BY REFERENCE

The disclosures of U.S. Provisional Patent Application No. 63/145,056, which was filed on Feb. 3, 2021, and U.S. patent application Ser. No. 17/590,902, filed Feb. 2, 2022, are hereby incorporated by reference for all purposes as if presented herein in their entirety.

TECHNICAL FIELD

The present disclosure relates to methods and systems for connecting a handrail to a support structure. More specifically, the present disclosure is directed to a connector for attaching a handrail to a newel, a wall, or another support structure and a method of attaching a handrail to a support structure with a connector.

BACKGROUND OF THE DISCLOSURE

In some examples, handrails can help to provide a physical barrier and/or hold-support for navigation along a stair or balcony in order to help prevent injurious falls. In addition to their utilitarian value, handrails also can contribute to the aesthetics of the stairway and/or balcony. Handrails may be offered in a variety of profiles and may be manufactured from wood and steel or other suitable materials.

In one example, a staircase can be installed by installing treads and risers followed by newel posts as needed. Balusters can be installed on the treads such as by drilling bores or holes in the treads and the balusters can be at least partially received in the holes so that the balusters extend upwardly from the holes in the treads. Alternatively, or in addition, balusters can be installed in holes formed along a landing, a balcony, etc. In some examples, bores can be drilled in an underside of a handrail and the handrail can be cut to length at a predetermined angle (e.g., so that the handrail can extend along the rake of the treads and risers or can extend horizontally along a balcony, a landing, etc.). The handrail can be positioned over the top ends of the balusters so that the tops of the balusters are at least partially received in the bores in the handrail. In some examples, the ends of the handrail can be fastened to the posts and/or walls and/or other suitable support structures with adhesive/glue, fasteners (e.g., screws, nails, nuts and bolts, etc.) and/or other suitable features. As a result, the balusters can be held at their top and bottom ends, which can help prevent removal of the balusters without damaging them. Subsequently, the balusters can be aligned and locked into place by securing the tops and/or bases of the balusters with adhesive/glue, fasteners (e.g., screws, nails, fine wire nails, etc.) and/or other suitable features where applicable.

An aspect of the installation of a handrail that can be improved and/or eased is the process of securing the top handrail to posts, walls, and/or other support structures. In many circumstances, creating a stable and aesthetically pleasing handrailing system can be a very laborious task and can take considerable craftsmanship and skill to ensure all the parts are properly aligned and suitably fastened together. In some examples, the handrail can be secured to a support with the use of hardware such as a hanger bolt, which can include two threaded sections, one adapted to screw into the post and the other adapted to receive a nut. For example, the first section of the hanger bold can be screwed into a pilot hole drilled in a newel post, a wall stud, or another support. A relatively large access hole can be drilled into the handrail from its bottom and a second through hole can be drilled inwardly from the end of the handrail until it intersects the access hole. Minor errors in measurement and/or drilling in the handrail and/or the support can result in misalignment of the handrail and/or support features, which can prevent the proper installation of the handrail. For example, if the access opening and the through hole in the handrail do not properly intersect, it may not be possible to tighten the nut on the hanger bolt.

Subsequently, the end of the handrail can be positioned relative to the support so that the second section of the hanger bolt is at least partially received in the through hole and advanced until the second end of the hander bolt resides in the access hole. A washer and a nut can be engaged with the second section of the hanger bolt via the access opening in the bottom of the handrail to secure the end of the handrail to the support via the hanger bolt. In some situations, this can be a difficult task due to the size of the access hole relative to the size of the washer, the nut, the fingers of the installer, and/or a wrench, pliers, and/or other tool used to tighten the nut. The access hole can limit the range of motion of the wrench, which can make tightening the bolt more challenging (e.g., by making it difficult to provide a proper amount of force to fully tighten the handrail bolt assembly). Further, in some circumstances, the position of the balusters and newel posts relative to the wrench can also interfere with tightening of the nut, especially for non-level handrails. In some examples, a plug can be installed to hide the assembly connection in the underside of the handrail and/or in the newel post. The plugs can be selected to match the material of the handrail and/or post and, for wooden handrails and/or newel posts, for alignment of the grain in order to disguise the plug.

SUMMARY OF THE DISCLOSURE

In general, one aspect of the disclosure is directed to a handrail attachment system. The system can comprise a connector comprising a body for being at least partially received in a recess in a support structure and an outer face for engaging an end face of a handrail. The connector can include a handrail mounting hole extending in the body for at least partially receiving a first fastener for at least partially mounting the connector to the end face of the handrail and a support mounting hole extending in the body for at least partially receiving a second fastener for mounting the connector to the support structure.

In another aspect, the disclosure is generally directed to a method of attaching a handrail to a support structure. The method can comprise obtaining a connector comprising a body and an outer face, mounting the connector to an end face of a handrail with the outer face of the connector engaging the end face of the handrail, positioning the body to be at least partially received in a recess in a support structure, and mounting the connector to the support structure.

In another aspect, the disclosure is generally directed to a handrail and support assembly. The handrail and support assembly can comprise a handrail having an end face, a support structure having a recess defined therealong, and a connector mounted to the handrail with at least a first fastener and to the support structure with at least a second fastener. The connector can comprise a body at least partially received in the recess of the support structure and an outer face engaging the end face of the handrail.

Additional aspects, features, and advantages of the present invention will become apparent from the following description and accompanying figures.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of connecting a handrail to a support structure. In embodiments, the disclosure includes a handrail connector that connects (e.g., universally connects) a handrail to a hollow or solid newel post or another suitable support structure. In some embodiments, the handrail connector can facilitate the installation of an angled handrail system, such as those associated with stairs or ramps, a handrail system having no angle (e.g., horizontal handrails along balconies, stair landings, etc.), and/or other suitable handrail assemblies. The handrail connector can be adaptable to be used with numerous different handrail systems and angles.

Figure 6:
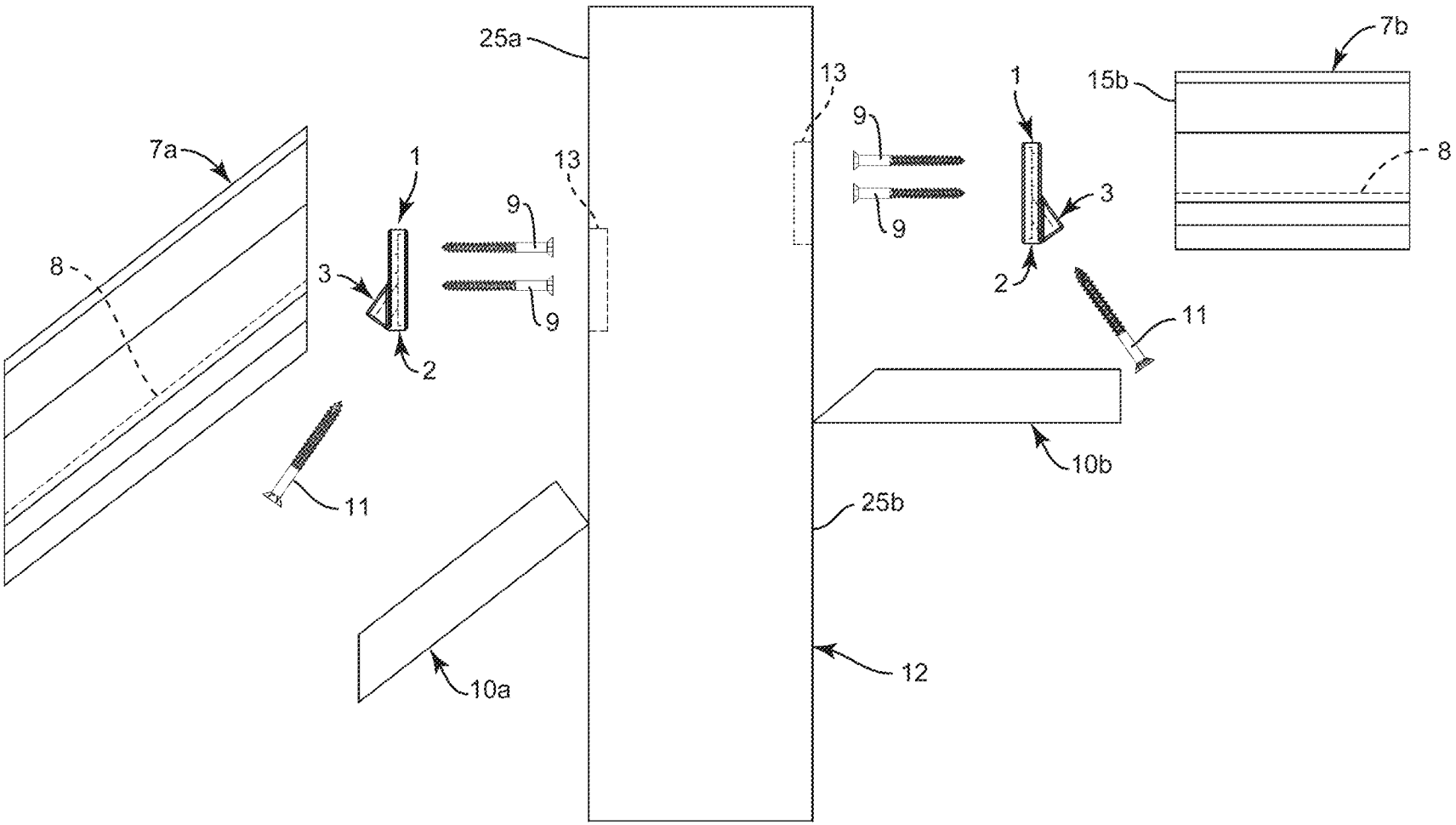
FIG. 6 is a side elevation exploded view of the handrail and newel assembly of FIGS. 4A and 4B.
Figure 7:
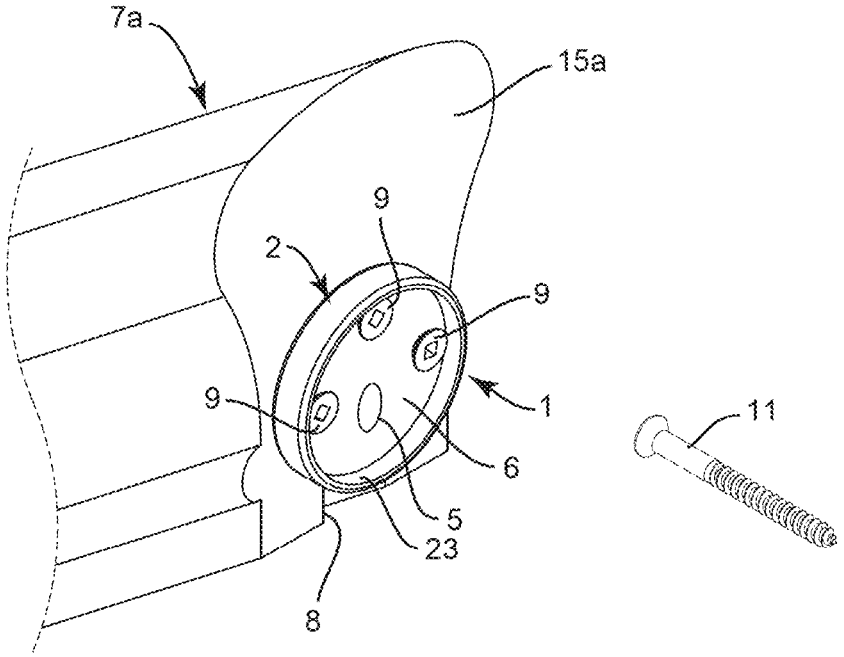
FIG. 7 is a perspective view of the handrail of FIG. 4A and the handrail connector of FIG. 1.

FIGS. 1-7 generally illustrate an example embodiment of a handrail connector 1 (FIGS. 1-3 and 4B-7), a handrail and support assembly 101 (FIGS. 4A-7) including the handrail connector 1, and a method of forming the handrail and support assembly 101 with the handrail connector 1 in accordance with the disclosure. In one embodiment, the handrail and support assembly 101 (FIGS. 4A-7) can include one or more handrails 7*a*, 7*b* mounted on a newel post 12 with the handrail connector 1 positioned between the newel post 12 and each of the handrails 7*a*, 7*b*. As shown in FIG. 4A, the newel post 12 can be mounted (e.g., in a vertical orientation) on a floor portion 103 (e.g., a landing, a balcony, etc.) adjacent a stair 105 including a plurality of steps 107 and risers 109 (only one step 107 and riser 109 is shown in FIG. 4A). In the illustrated embodiment, the handrail 7*a* is mounted at an angle with respect to the newel post 12 so that the handrail 7*a* extends along the rake of the stair 105, and the handrail 7*b* is mounted to the newel post 12 to extend horizontally along the floor portion 103. As shown in FIGS. 4B, 6, and 7, the handrail 7*a* can have an end face 15*a* that is cut at an angle so that the end face 15*a* can be in face-to-face contact with a vertical face of the newel post 12 or other support when the length of the handrail 7*a* extends along the rake of the stairs, and the handrail 7*b* can have an end face 15*b* that is perpendicular to the length of the handrail 7*b* so that the handrail 7*b* extends horizontally when the end face 15*b* is in face-to-face contact with a vertical face of the newel post 12 or other support. In alternative embodiments, any suitable number of handrails could be mounted to the newel post 12 in any suitable combination of angled and horizontal configurations. Further, the newel post 12 could be mounted anywhere along the floor portion 103 (e.g., spaced apart from any stairs) or could be mounted along a stair (e.g., on a step 107 of a stair). While the handrail and support assembly 101 is illustrated with the handrails 7*a*, 7*b* mounted on a newel post 12, the newel post could be replaced by any suitable support structure (e.g., a wall). In addition, while only one support structure (e.g., newel post 12) is shown, each handrail 7*a*, 7*b* could be mounted between two support structures (e.g., between two newel posts 12, between two walls, and/or any suitable combination thereof).

Figure 1:
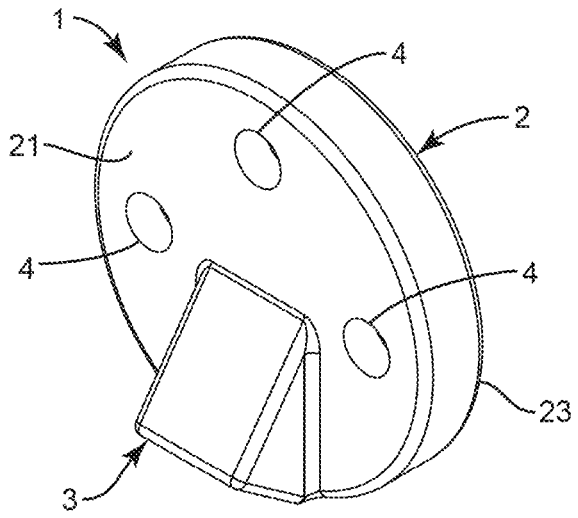
FIG. 1 is a perspective view of a handrail connector for attaching a handrail to a support structure according to an exemplary embodiment of the disclosure.
Figure 2:
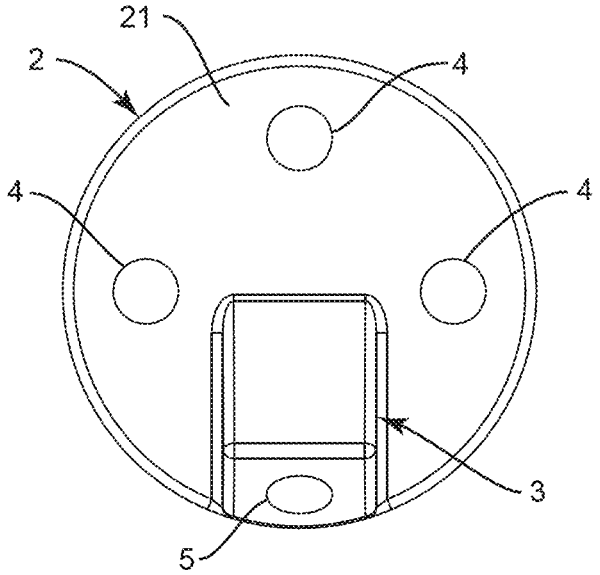
FIG. 2 is a front elevation view of the handrail connector of FIG. 1.
Figure 3:
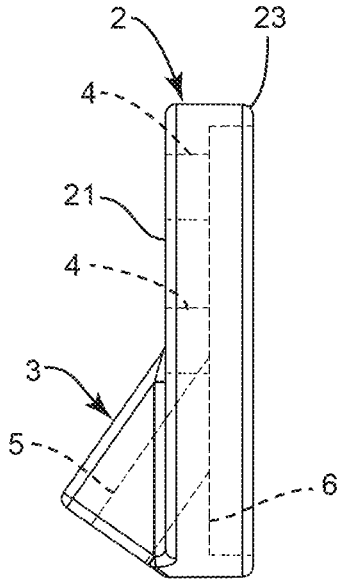
FIG. 3 is a side elevation view of the handrail connector of FIG. 1.
Figure 4A:
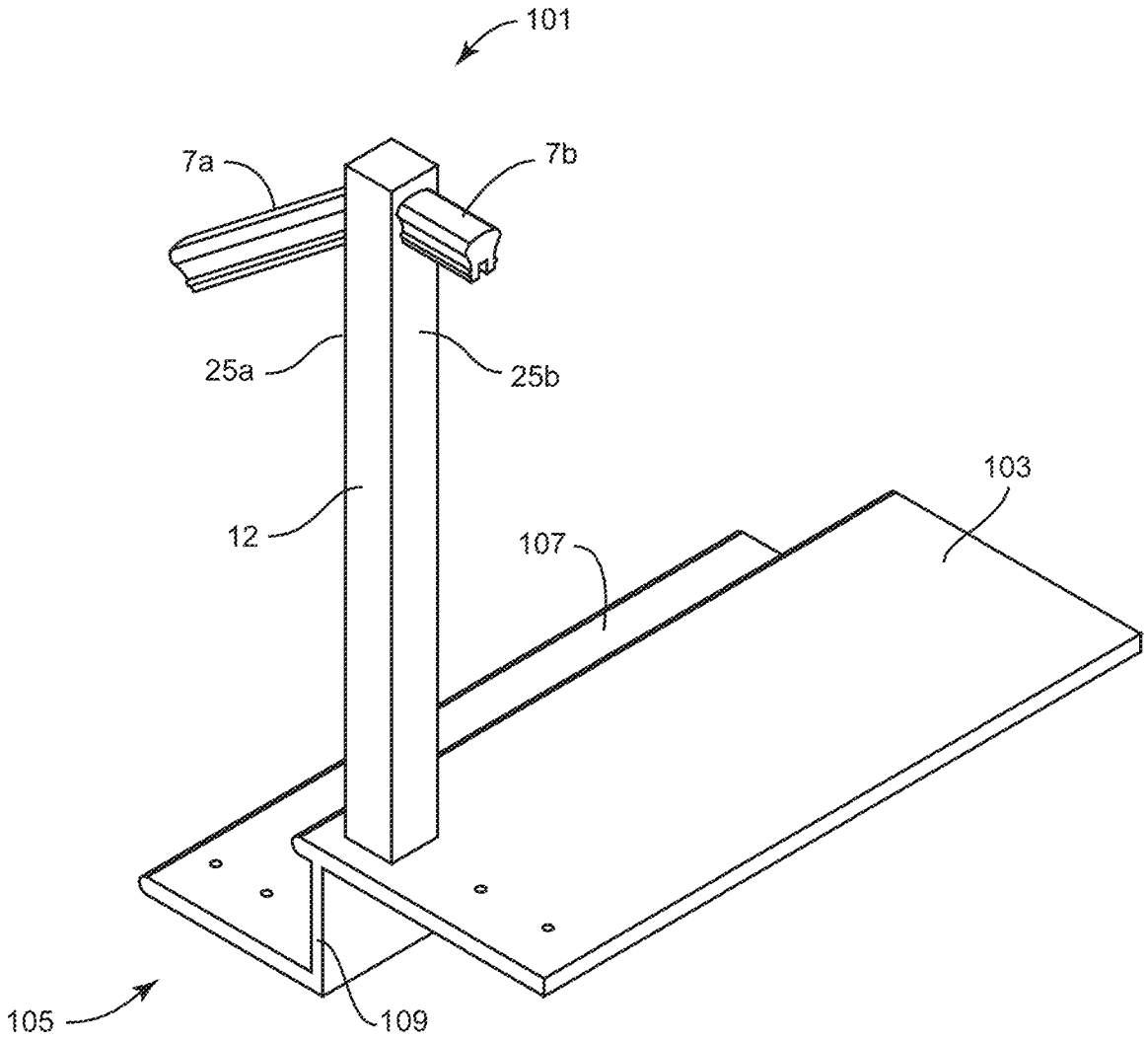
FIG. 4A is a perspective view of a handrail and newel assembly according to an exemplary embodiment of the disclosure.
Figure 4B:
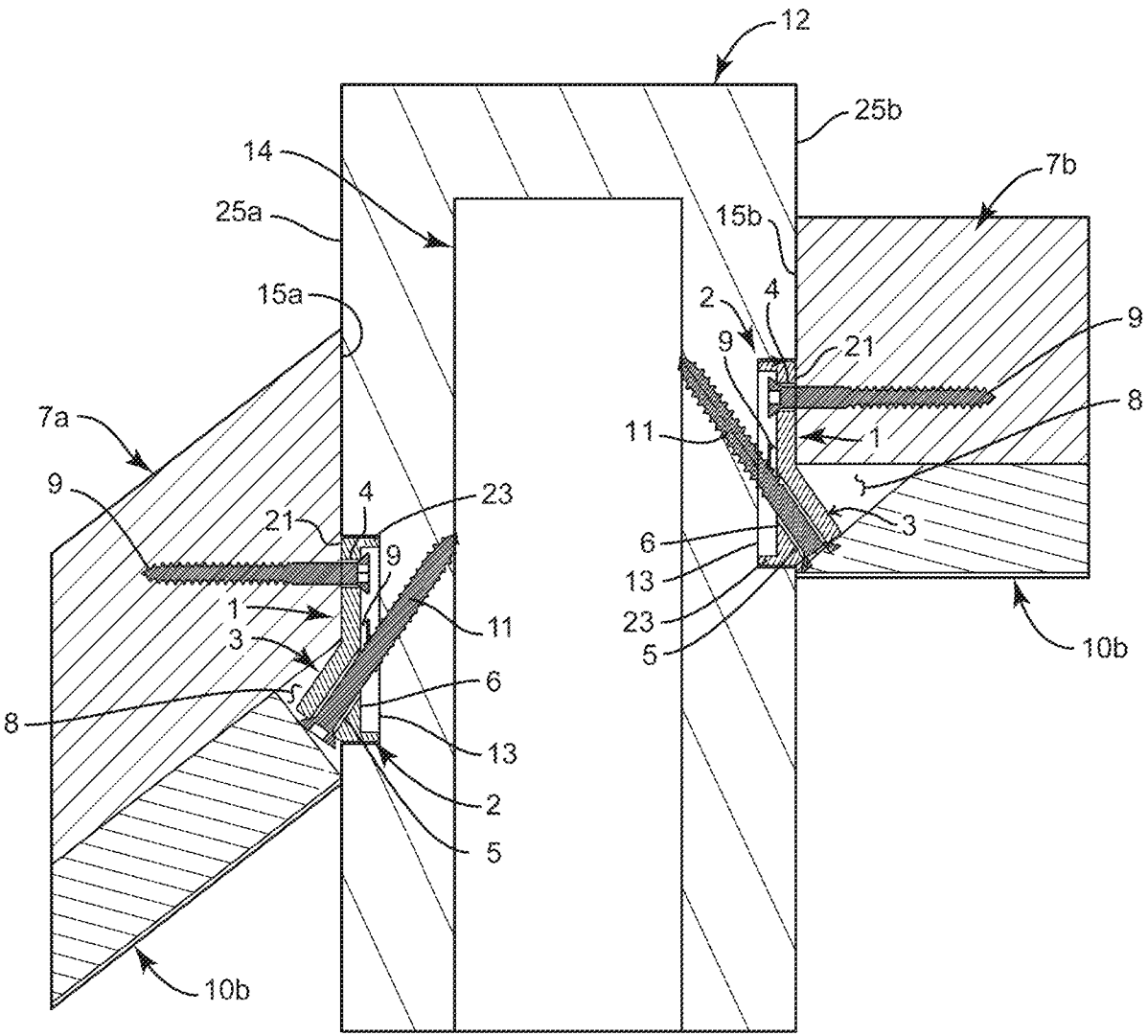
FIG. 4B is a cross-sectional view of the handrail and newel assembly of FIG. 4A including the handrail connector of FIG. 1.
Figure 5:
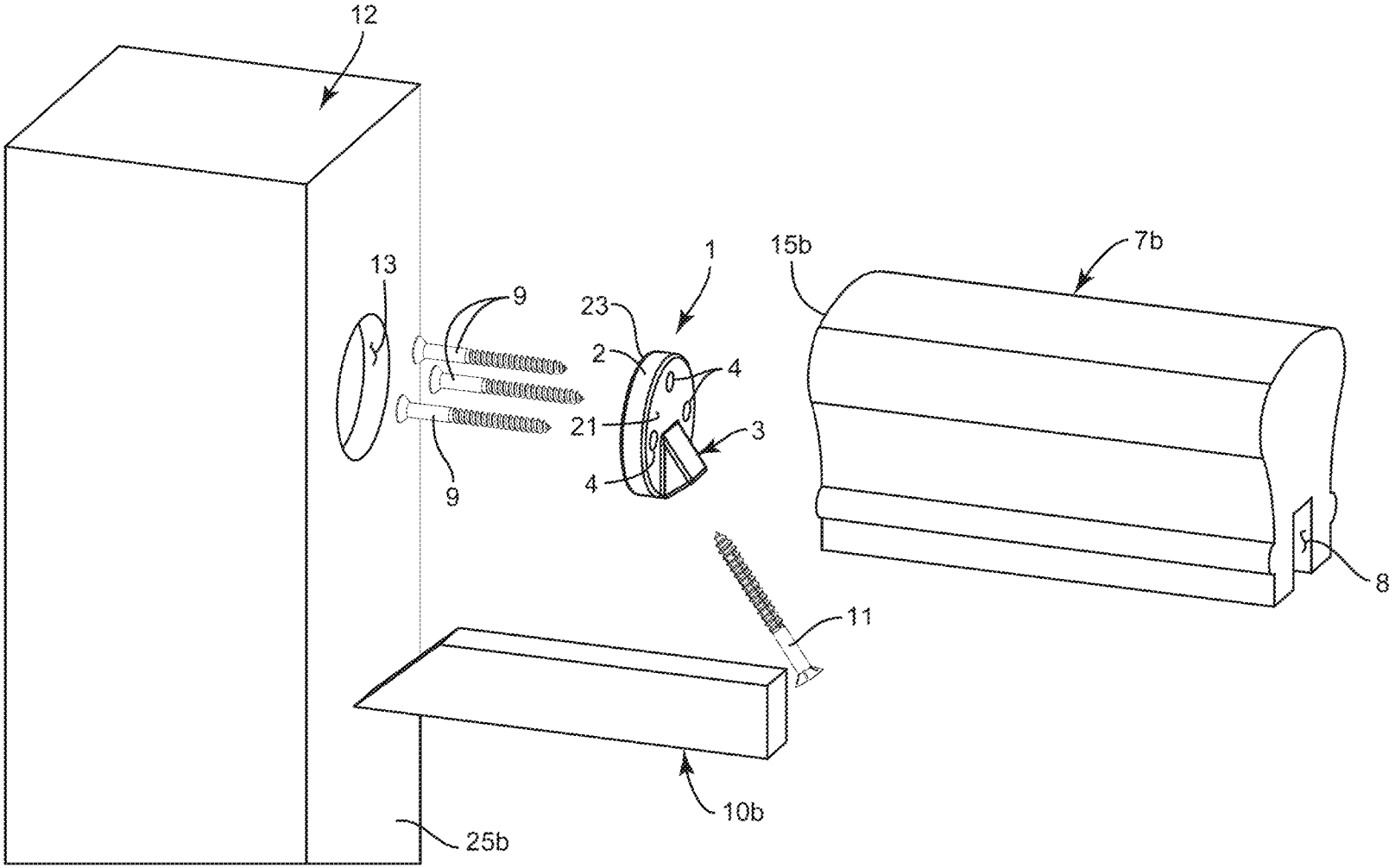
FIG. 5 is a perspective exploded view of the handrail and newel assembly of FIGS. 4A and 4B.

As shown in FIGS. 1-3, the connector 1 can include a body 2 (e.g., comprising a circular disc or other suitable structure) with an outer face 21 (e.g., a first face) and a recessed face 6 (e.g., a second face) opposite to the outer face 21. In the illustrated embodiment, a plurality of handrail mounting holes 4 can extend through the body 2 to butt join a handrail 7*a*, 7*b* to a side face 25*a*, 25*b* of the newel post 12 or other support. In one embodiment, the handrail mounting holes 4 can be positioned along an axial direction (e.g., along a direction that is parallel with the central axis of the body 2) for mounting the body 2 directly to an end face 15*a*, 15*b* of the handrail 7*a*, 7*b*. As shown in FIG. 2, the handrail mounting holes 4 are radially spaced from the central axis of the body 2. While three handrail mounting holes 4 are shown in the illustrated embodiment, the connector 1 could include any suitable number of handrail mounting holes 4 (e.g., one or more) positioned at any suitable location and orientation in the body 2. As shown in FIGS. 3, 4B, and 7, a rim 23 can extend along the perimeter (e.g., circumference) of the body 2 and the recessed face 6. In one embodiment, the rim 23 and the recessed face 6 can at least partially define a cavity or recess in the body 2 that can contain the heads of the fastening hardware engaging the handrail mounting holes 4 and can provide additional depth to the body 2 for seating inside of the newel post 12 or other support.

As shown in FIGS. 1-3 and 4B, the connector 1 can include a protruding wedge-shaped extrusion 3 extending from the outer face 21 of the body 2, and an oblique mounting hole 5 can extend through the extrusion 3 to the recessed face 6 of the body 2. In the illustrated embodiment, the oblique mounting hole 5 can be oblique with respect to the axial and radial directions of the body 2 and/or with respect to the outer face 21 and/or the recessed face 6. In one embodiment, the oblique mounting hole 5 can be angled toward the center of the body 2, and the shape of the extrusion 3 can follow the angle of the oblique mounting hole 5. For example, the extrusion can have opposing vertical sides and an oblique surface each extending from the outer face 21 to at least partially form the wedge shape of the extrusion 3, and the oblique surface can extend between the vertical sides of the extrusion 3 at least partially parallel to the oblique mounting hole 5. The connector 1, including at least the body 2, the handrail mounting holes 4, the rim 23, the oblique mounting hole 5, and/or the extrusion 3, could be otherwise shaped, positioned, arranged, and/or configured without departing from the disclosure. For example, while the body 2 has a circular shape in the figures, the body 2 could be any suitable shape. In another example, the extrusion 3 could be omitted and/or any suitable number of oblique mounting holes 5 could be included.

As shown in FIGS. 4B-6, the newel 12 or other support can include a recess 13 (e.g., a shallow hole or blind bore) that can be sized and/or shaped to at least partially receive the body 2 of the connector 1. In one embodiment, the recess 13 can be drilled in a face of the newel 12 or other support. A circular shape of the body 2 can allow for simple drilling of the newel post 2 or other support for receiving the body 2; however, the support could be drilled and/or routed to accommodate a connector 1 having a body 2 with any suitable shape. In the illustrated embodiment, the recess 13 can have a depth that can be equal to or greater than the distance from the outer face 21 to the edge of the rim 23 of the connector body 2, which can enable a flush butt joint between the newel post 12 and the handrail 7*a*, 7*b*. Alternatively, the recess 13 could have any suitable depth for receiving any suitable portion of the connector 1. When the body 2 is at least partially received in the recess 13, the recess 13 can at least partially retain the connector 1 in position.

In the illustrated embodiment, each of the handrails 7*a*, 7*b* can include a channel or route 8 along its underside (FIGS. 4B-7). The route 8 can be formed by a router or other suitable tools and can extend along any suitable length of the handrail 7*a*, 7*b* or along the entire length of the handrail. In one embodiment, the route 8 can be sized to receive the extrusion 3 so that the extrusion 3 can act as a locating guide and stop for locating the body 2 along the end face 15*a*, 15*b* of the handrail 7*a*, 7*b*. For example, the width of the extrusion 3 can slidingly and/or tightly fit between the sides of the route 8. Utilizing the sides and bottom of the route 8, the extrusion 3 can help position the connector 1 on the end of the handrail 7*a*, 7*b*, which can help reduce or eliminate the need for measurements on the handrail. In an exemplary embodiment, the route 8 can be centered between the sides of the handrail 7*a*, 7*b* so that the connector 1 is centered laterally on the end face 15*a*, 15*b* of the handrail 7*a*, 7*b* when the extrusion 3 is received in the route 8. Further, the top edge of the extrusion 3 can be used to locate the connector 1 along the vertical axis of the handrail profile 15*a*, 15*b*. In one embodiment, the angled surface of the extrusion 3 can be an accessible mounting surface for the handrail 7*a* mounted to the support along the rake of the stairs and the handrail 7*b* mounted to the support horizontally. As shown in FIGS. 4B-6, a handrail fillet 10*a*, 10*b* may be used to fill the void along the bottom of the handrail 7*a*, 7*b*, between the newel post 12 and a baluster (not shown), for example.

In the illustrated embodiment, the connector 1 can be mounted to the end face or handrail profile 15*a*, 15*b* of the handrail 7*a*, 7*b* when the extrusion 3 is at least partially received in the route 8 and the outer face 21 of the body 2 is in face-to-face contact with the end face 15*a*, 15*b* of the handrail. For example, three handrail attachment screws 9 or other suitable fasteners can be inserted through the handrail mounting holes 4 in the body 2 from the recessed face 6 and can be screwed into the handrail 7*a*, 7*b* via the end face 15*a*, 15*b*. In some embodiments, pilot holes can be drilled into the end face 15*a*, 15*b* before screwing the screws 9 into the handrail. While three handrail attachment screws 9 are included in the illustrated embodiment, any suitable number of handrail attachment screws 9 could be used (e.g., one or more of the handrail mounting holes 4 could be left unused and/or in embodiments wherein the connector 1 has a different number of handrail mounting holes 4). In the illustrated embodiment, the heads of the screws 9 can be positioned within the cavity formed by the recessed face 6 and the rim 23 of the body 2 so that the screws 9 do not interfere with the positioning of the body 2 within the recess 13 of the newel post 12 or other support. In some embodiments, the rim 23 and the cavity can help provide additional thickness around the perimeter of the connector body 2 without adding an excess of material to the overall connector 1 (e.g., so that the connector is lighter and uses less material). With a larger surface area around the perimeter of the body 2, the seating and positioning of the connector 1 relative to the newel post 12 is further secured and allows the handrail 7*a*, 7*b* to be mounted to the support with fewer hands or clamps that otherwise may be needed to hold the handrail 7*a*, 7*b* in place during installation.

As shown in the cross-sectional view of FIG. 4B, the handrail 7*a*, 7*b* with the connector 1 mounted to the end face 15*a*, 15*b* can be positioned relative to the newel post 12 so that the body 2 of the connector 1 is at least partially received in the recess 13 of the newel post 12 and the end face 15*a*, 15*b* is engaged (e.g., in face-to-face contact) with the respective side 25*a*, 25*b* of the newel post 12. In the illustrated embodiment, prior to the assembly of the fillet 10*a*, 10*b*, a newel mounting screw 11 or other suitable fastener can be inserted through the oblique mounting hole 5 via the route 8 in the handrail 7*a*, 7*b* and can be screwed into the side 25*a*, 25*b* of the newel post 12 at the oblique angle of the oblique mounting hole 5. In some embodiments, a pilot hole can be drilled in the newel post 12 prior to screwing the screw 11 in place. While one newel mounting screw 11 is included in the illustrated embodiment, the connector 1 could include any suitable number of oblique mounting holes 5 and any suitable number of newel mounting screws 11 could be used to secure the connector 1 to the newel post 12. In an exemplary embodiment, FIG. 4B can demonstrate an advantage of angling the screw 11 upwardly into the newel post 12, which can include a hollow portion 14. In alternative configurations that use horizontally-mounted hanger bolt hardware instead of the connector 1, the amount of threaded contact into a hollow newel post 12 would be reduced (e.g., by at least 20%) compared to the angled screw 11.

In exemplary embodiments, the route 8 along the bottom of the handrail 7*a*, 7*b* can partially conceal the attachment screw 11 between the sidewalls of the route, while the recess 13 of the newel post 12 at least partially conceals the connector 1. In the illustrated embodiment, the fillet 10*a*, 10*b* can be inserted into the route 8 after the screw 11 is secured in place to further conceal the mounting screw 11 and the extrusion 3 on the underside of the handrail 7*a*, 7*b*.

As shown in FIG. 4B, the ends of the fillet 10*a*, 10*b* can be cut to accommodate the extrusion 3 and the screw 11 in the respective angled configuration and horizontal configuration.

In an exemplary embodiment, the handrail and support assembly 100 can be assembled by placing the connector 1 along the handrail profile face 15*a*, 15*b*, positioning the wedge-shaped extrusion 3 in the route 8 and positioning the outer face 21 of the connector 1 against the end face 15*a*, 15*b* of the handrail 7*a*, 7*b*. In an exemplary embodiment, the wedge-shaped extrusion 3 can fit tightly or somewhat tightly in the route 8 so that the interaction between the route 8 and the extrusion 3 can help hold the connector 1 in place against the handrail profile face 15*a*, 15*b* during assembly. Once the handrail connector 1 is in position, three screws 9 can mount the handrail connector 1 to the handrail profile 15*a*, 15*b*, as shown in FIGS. 4B and 7. Next, the recess 13 can be drilled or otherwise formed in the side 25*a*, 25*b* of the newel post 12 at a desired location for the mounting of the handrail 7*a*, 7*b*. In an exemplary embodiment, the recess 13 is slightly deeper than the body 2 of the handrail connector 2 (e.g., not including the extrusion 3) for a flush butt joint between the handrail 7*a*, 7*b* and the newel post 12. Subsequently, the handrail 7*a*, 7*b* can be positioned relative to the side 25*a*, 25*b* of the newel post 12 and the body 2 of the handrail connector 1 can slide into the recess 13 of the newel post 12. Once handrail connector 1 is in position, the handrail sits freely in between newel posts 12 ready to be tightly fastened. One benefit to having the handrail connector 1 sit inside the recess 13 is that it can help eliminate or reduce the need for additional installers onsite to hold the handrail 7*a*, 7*b* in position during installation. Next, to secure the handrail 7*a*, 7*b* to the newel post, a newel post mounting screw 11 can be inserted through the angled mounting hole 5 of the connector 1 and into the newel post 12. The angled screw 11 can pull the handrail 7*a*, 7*b* up and into the top portion of the recess 13, which can help provide a tight and flush butt joint connection. Subsequently, the fillet 10*a*, 10*b* can be mounted in the route 8 to at least partially conceal the bottom of the handrail connector 1 and handrail route 8. In exemplary embodiments, the fillet 10*a*, 10*b* can be secured with pin nails through the side of the handrail 7*a*, 7*b* and/or from underneath the handrail 7*a*, 7*b* and through the bottom of the fillet 10*a*, 10*b*.

The handrail and support assembly 101 could be otherwise formed from the connector 1, the handrail 7*a*, 7*b*, and the newel post 12 or other support without departing from the disclosure. For example, the extrusion 3 could be omitted and the body 2 could be otherwise located on the end face 15*a*, 15*b* of the handrail 7*a*, 7*b*. In addition, any suitable number of fasteners 8, 11 could be used to secure the connector 1 to the handrail 7*a*, 7*b* and the newel post 12. Further, the recess 13 could be formed in the newel post 12 prior to attaching the connector 1 to the handrail 7*a*, 7*b* (e.g., the recess 13 can be pre-formed for easier assembly).

In the illustrated embodiment, the handrail connector 1 can provide a hardware insert that can allow for easy and rapid installation of a handrail to a support structure such as a newel post or a wall for handrails installed along the rake of a stair and for handrails installed horizontally. Further, in embodiments of the present disclosure, the attachment screw angle can provide several benefits for the overall system. For example, by angling the fastening hardware upwardly into the newel post 12 allows for a higher percentage of threaded contact into applications where a hollow newel post 12 is used verses a hanger bolt or another application that lacks an angled fastener. In another example, the angle of the fastener, as guided by the extrusion 3 and the oblique mounting hole 5, is accessible along different handrail types, such as level handrails and handrails mounted along the rake of a stair, and the angled fastener is more easily tightened to secure handrail 7*a*, 7*b* to the newel post 12. In addition, the body 2 of the connector 1 can help support the handrail 7*a*, 7*b* during assembly by resting in the recess 13 of the newel post 12 or other support structure, and, when the body 2 is in the form of a circular disk, it can be easy to measure and drill the recess 13, which can help simplify the preparation of the newel post 12 or other support for installation.

Any of the features of the various embodiments of the disclosure can be combined with, replaced by, or otherwise configured with other features of other embodiments of the disclosure without departing from the scope of this disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A connector for an attachment system, the connector comprising:

a body for being at least partially received in a recess in a first element;

an outer face for engaging an end face of a second element;

a first mounting hole extending in the body for at least partially receiving a first fastener for mounting the connector to the first element, wherein the first mounting hole extends obliquely with respect to the outer face of the connector and with respect to an axial direction of the connector, and the first mounting hole extends through a mounting surface of the connector that is nonparallel with the outer face; and a second mounting hole extending in the body for at least partially receiving a second fastener for at least partially mounting the connector to the end face of the second element.

2. The connector of claim 1, wherein the first mounting hole extends toward a center of the body.

3. The connector of claim 1, wherein the connector further comprises an extrusion extending from the outer face for engaging a route in the second element, and the second mounting hole extends through the extrusion toward a center of the body.

4. The connector of claim 3, wherein the extrusion is configured for engaging one or more sides of the route for facilitating positioning of the connector on the end face of the second element.

5. The connector of claim 3, wherein the extrusion comprises at least an oblique surface extending from the outer face of the connector, and the oblique surface and the first mounting hole are at least partially parallel.

6. The connector of claim 5, wherein the mounting surface is nonparallel with the oblique surface of the extrusion.

7. The connector of claim 1, wherein the connector further comprises a recessed face opposite to the outer face and a rim extending along a circumference of the recessed face, and the recessed face and the rim at least partially form a cavity in the body for accommodating at least a portion of the second fastener.

8. The connector of claim 1, wherein the second mounting hole is radially spaced from a central axis of the body and extends along the axial direction.

9. A method of attaching a first element and a second element, the method comprising:

obtaining a connector comprising a body and an outer face, wherein a first mounting hole and a second mounting hole each extend in the body, and wherein the first mounting hole extends in an oblique direction with respect to the outer face of the connector and with respect to an axial direction of the connector, and the first mounting hole extends through a mounting surface of the connector, the mounting surface being nonparallel with the outer face;

mounting the connector to an end face of the second element with a second fastener at least partially received through the second mounting hole, the outer face of the connector engaging the end face of the second element;

positioning the body to be at least partially received in a recess in the first element; and mounting the connector to the first element with a first fastener at least partially received through the first mounting hole.

10. The method of claim 9, wherein the mounting the connector to the first element comprises securing the first fastener to the second element via the first mounting hole and the recess of the first element.

11. The method of claim 9, wherein the second element comprises a route, the connector comprises an extrusion extending from the outer face of the connector, and the first mounting hole extends through at least the extrusion, and wherein the method further comprises positioning the extrusion at least partially within the route and positioning the outer face of the connector in face-to-face contact with the end face of the second element prior to the mounting the connector to the end face of the second element.

12. The method of claim 11, further comprising securing a fillet in the route of the second element after the securing of the first fastener to the first element.

13. The method of claim 9, wherein the first element is at least one of a wall and a newel post and the second element is a handrail.

14. A handrail and support assembly, comprising:

a handrail having an end face;

a support structure having a recess defined therealong; and a connector mounted to the support structure with at least a first fastener and to the handrail with at least a second fastener, the connector comprising:

a body at least partially received in the recess of the support structure;

an outer face engaging the end face of the handrail, a support mounting hole extending in the body and at least partially receiving the first fastener, wherein the support mounting hole and the first fastener extend obliquely with respect to the outer face of the connector and with respect to an axial direction of the connector, and the support mounting hole extends through a mounting surface of the connector that is nonparallel with the outer face; and a handrail mounting hole extending in the body and at least partially receiving the second fastener.

15. The assembly of claim 14, wherein the support mounting hole extends toward a center of the body and the handrail mounting hole is spaced from a central axis of the body.

16. The assembly of claim 14, wherein the handrail comprises a route, the connector comprises an extrusion extending from the outer face, the support mounting hole extends through at least the extrusion, and the extrusion is at least partially received in the route of the handrail.

17. The assembly of claim 16, wherein the extrusion engages one or more sides of the route for facilitating positioning of the connector on the end face of the handrail.

18. The assembly of claim 16, wherein the extrusion comprises at least an oblique surface extending from the outer face of the connector, the oblique surface and support first mounting hole are at least partially parallel, and the mounting surface is nonparallel with the oblique surface of the extrusion.

19. The assembly of claim 14, wherein the connector further comprises a recessed face opposite to the outer face and a rim extending along a circumference of the recessed face, and the recessed face and the rim at least partially form a cavity in the body accommodating at least a portion of the second fastener within the recess of the support structure.

* * * * *